United States Patent [19]

Parsons

[11] 4,428,337

[45] Jan. 31, 1984

[54] VARIABLE CYLINDER OPERATION OF INTERNAL COMBUSTION ENGINE

[76] Inventor: William D. Parsons, 5408 Manrison Dr., Cross Lanes, W. Va. 25313

[21] Appl. No.: 285,372

[22] Filed: Jul. 14, 1981

[51] Int. Cl.[3] ..... F02D 17/02

[52] U.S. Cl. ..... 123/198 F; 261/23 A

[58] Field of Search ..... 123/198 F, DIG. 6, DIG. 7; 261/23 A

[56] References Cited

U.S. PATENT DOCUMENTS

| | | | |
|---|---|---|---|
| 4,106,471 | 8/1978 | Nakajima et al. | 123/198 F |
| 4,124,012 | 11/1978 | Fuller, Jr. | 123/198 F |
| 4,172,434 | 10/1979 | Coles | 123/198 F |
| 4,215,845 | 8/1980 | Sturgeon | 123/198 F |
| 4,261,311 | 4/1981 | Rupe | 123/198 F |
| 4,285,494 | 8/1981 | Sturgeon | 123/198 F |

*Primary Examiner*—Ira S. Lazarus
*Attorney, Agent, or Firm*—Harvey B. Jacobson

[57] ABSTRACT

An insert plate is provided for mounting between the base mounting flange of a carburetor including a pair of air and fuel passages extending therethrough and an intake mounting boss having a corresponding pair of air and fuel passages formed therein with which the carburetor passages may be registered. The insert plate includes a pair of openings formed therethrough for registry with the carburetor and intake manifold air and fuel passages and defines an inlet extension of the manifold. A valve member is shiftably supported from the plate for movement between one of three positions, including a first position closing only one of the openings with the second opening unobstructed to the flow of fluid therethrough, a second position closing only the other of said openings and with said one opening unobstructed to the flow of fluid therethrough and a third out-of-the-way position with each of said openings unobstructed to the flow of fluid therethrough. Shift structure is operatively associated with the valve member, the latter being yieldingly biased to the third position thereof, and the shift structure is operative to alternately shift the valve member to the first and second positions thereof responsive to sequential operation of an associated engine. Further, the shift structure is also operative to automatically allow the valve member to shift to the third position thereof responsive to heavy load operating conditions of the associated engine.

7 Claims, 3 Drawing Figures

SEQUENTIAL RELAY
ENGINE VACUUM SWITCH
10
12
14
16
30
32
36
46
48
50
52
54
56
2
78
80
70
72
74
76

58
60
62
64
66
68

12
14
16
20
22
24
26
28
30
34
36
38
40
42
44
46
48
52

VARIABLE CYLINDER OPERATION OF INTERNAL COMBUSTION ENGINE

BACKGROUND OF THE INVENTION

Various forms of devices heretofore have been provided for selective operation of an eight cylinder engine on only four cylinders thereof, a six cylinder engine on only three cylinders thereof and a two cylinder engine on only one cylinder thereof. Some of these previous devices are used in conjunction with combustion engines including at least two individual intake manifold air and fuel passages for supplying a fuel and air charge to separate sets of cylinders of the engine and function to selectively block one of the air and fuel passages whereby the engine will operate on only one-half the number of cylinders included in the engine. However, these previously known structure have been inoperative to readily alternate the air and fuel passage to be blocked and have further been inoperative to effect such alternate blocking of air and fuel passages automatically. Accordingly, a need exists for an improved apparatus and method for alternately blocking separate air and fuel intake passages of the intake manifold of a multicylinder combustion engine.

Examples of various forms of previously known structures for limiting operation of a combustion engine to operation of only one-half of cylinders thereof and which include some of the general structural and operational features of the instant invention are disclosed in U.S. Pat. Nos. 2,166,968, 2,918,047, 4,019,479, 4,109,634, 4,130,102, 4,198,940 and 4,201,179.

BRIEF DESCRIPTION OF THE INVENTION

In its simplest form, the structure of the instant invention is operative to block one of the air induction passages of a combustion engine and, in a more comprehensive form, is operative to alternately block the air and fuel intake passages of a multicylinder combustion engine responsive to sequential operation of the engine and also functions to terminate blockage of any of the air and fuel intake passages responsive to operation of the associated engine under heavy load conditions.

In this manner, longevity of the associated engine is increased as well as the fuel economy thereof when the engine is not operating under heavy load conditions and yet the ability to operate under heavy load conditions is not impaired. Also, inasmuch as alternate sets of cylinders of the combustion engine are deactivated as a result of blockage of the corresponding air and fuel intake passages, the associated engine does not operate each day on the same half set of cylinders until an adjustment to effect operation of the engine on the other half set of cylinders thereof. Instead, each time operation of the engine is terminated and restarted, a different half set of cylinders is deactivated.

The main object of this invention is to provide a structure and method for increasing the fuel efficiency and longevity of an associated reciprocating piston internal combustion engine.

Another object of this invention is to provide an apparatus in accordance with the preceding object and which will alternately effect operation of different half sets of the cylinders of a combustion engine responsive to sequential operation of the engine.

Yet another object of this invention is to provide an apparatus in accordance with the preceding objects and which will be deactivated, and thus enable operation of all of the cylinders of the associated combustion engine, in response to heavy load demand operation of the engine.

Still another object of this invention is to provide an apparatus for economy operation of an internal combustion engine and which may be readily incorporated into the manufacture of new engines as well as retrofitted to existing combustion engines.

A final object of this invention is to specifically enumerated herein is to provide an apparatus in accordance with the preceding objects and which will conform to conventional forms of manufacture, be of simple construction and easy to use so as to provide a device that will be economically feasible, long lasting and relatively trouble-free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
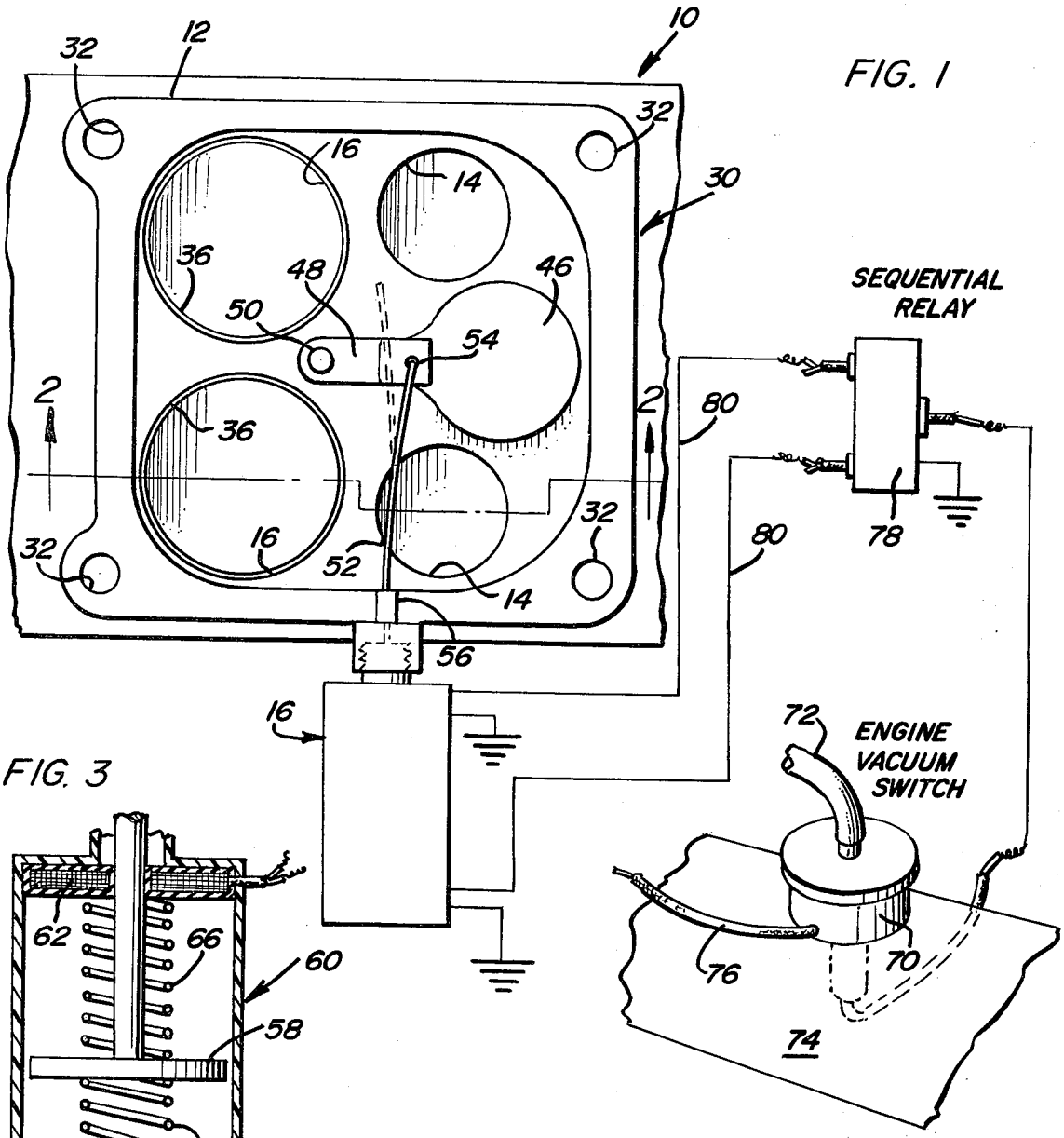
FIG. 1 is a top plan view of the instant invention as operatively associated with four intake passages of the intake manifold of a combustion engine including separate sets of passages for ducting air and fuel charges to half sets of cylinders of the engine, the control mechanism for the instant invention being partly diagrammatically illustrated and partly in fragmentary perspective.

Referring now more specifically to the drawings, the numeral 10 generally designates a multicylinder internal combustion engine of the V-8 type and wherein the engine 10 includes a manifold 12 including two pairs of primary and secondary air and fuel openings 14 and 16 at the inlet boss of the manifold 12 and with each pair of primary and secondary openings comprising the inlet for a separate set of air and fuel passages each operative to duct a fuel and air charge to one-half of the cylinders of the engine 10. The openings 14 comprise primary openings and the openings 16 comprise secondary openings. Conventionally, a four barrel carburetor referred to in general by the reference numeral 20 is mounted on the manifold 12 and includes a pair of primary air and fuel passages 22 registered with the openings 14 and a pair of secondary air and fuel passages 24 registered with the opening 16. The primary passages 22 are conventionally manually controlled by a manually actuated set of throttle plates 26 and the passages 24 are conventionally controlled by a pair of weighted pressure differential responsive throttle plates 28 which are normally closed and open only in response to heavy load operating conditions of the engine 10.

Figure 2:
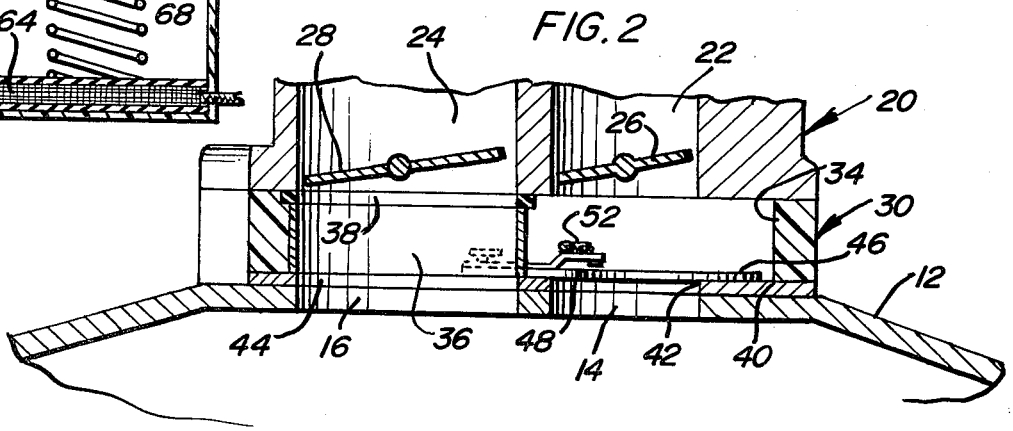
FIG. 2 is a fragmentary vertical sectional view taken substantially upon the plane indicated by the section line 2—2 of FIG. 1.

The instant invention includes an insert plate referred to in general by the reference numeral 30 insertable between the manifold 12 and the carburetor 20 in the manner illustrated in FIG. 2 of the drawings and the plate 30 includes four corner bores 32 formed therethrough by which the plate 30 may be bolted in position between the manifold 12 and the carburetor 20.

The plate 30 includes a large central cavity 34 formed therein and a pair of sleeves 36 and sealing O-rings 38 are provided for sealingly communicating the passages 24 with the openings 16 independent of the interior of the cavity 24. The lower end of the cavity 34 is closed by a bottom wall 40 having a pair of openings 42 formed therein registered with the openings 14 and a pair of openings 44 therein registered with the openings 16.

A flat valve plate 46 is provided and is mounted on one end of a swing arm 48 pivotally mounted at its other end as at 50 to the bottom wall 40 between the sleeves 36. The valve plate 46 is swingable into either of the phantom line positions thereof illustrated in FIG. 1 closing the associated openings 14 or the center solid line position illustrated in FIG. 1 disposed between the openings 14 and leaving the latter unobstructed to the flow of fluid therethrough.

Figure 3:
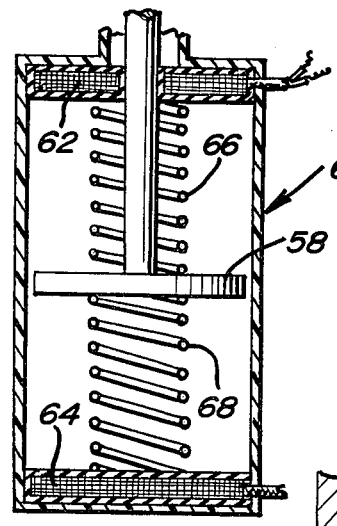
FIG. 3 is a fragmentary longitudinal vertical sectional view taken substantially upon the plane passing through the center of the double-acting solenoid control of the instant invention.

A pull rod 52 has one end thereof pivotally anchored to the arm 48 as at 54 and the other end portion of the rod 52 is slidably received through a lateral port 56 formed in the plate 30 and is anchored to an armature 58 within a double acting solenoid referred to in general by the reference numeral 60 and including opposite end coils 62 and 64. Compression springs 66 and 68 are disposed between the armature 58 and the coils 62 and 64 and yieldingly bias the armature 58 toward the centered position thereof illustrated in FIG. 3 corresponding to the center position of the valve plate 46 illustrated in solid lines in FIG. 1.

A vacuum actuated switch 70 is provided and is communicated with any suitable source of engine vacuum through a vacuum line 72. The switch 70 may be suitably mounted on any available portion 74 of the associated engine. Further, the vacuum switch 70 is serially connected within a circuit 76 also having a sequential relay 78 serially connected therein. The sequential relay 78 controls a pair of auxiliary circuits 80 and 82 in which the coils 62 and 64 are serially connected.

Each time the engine 10 is operated, the engine vacuum switch 70 will be closed to actuate the sequential relay thereby electrically actuating one of the coils 62 and 64. The next time the engine vacuum switch 70 is actuated the sequential relay 78 will actuate the other coil of the solenoid 60. Thus, the plate 46 will be alternately shifted between the two phantom line positions thereof illustrated in FIG. 1 of the drawings each time the engine 10 is operated and will be spring returned to the solid line position of FIG. 1 during periods of nonusage of the engine 10.

Still further, when the engine is operated under conditions resulting in low intake manifold vacuum, the switch 70 opens and current ceases to flow through the sequential relay and thus to either of the coils 62 and 64. Under these conditions, the solenoid 60 is deactuated during operation of the associated engine and the springs 66 and 68 yieldingly bias the armature 58 to the center position thereof and the plate 46 is displaced to the center position illustrated in solid lines in FIG. 1. Thus, regardless of which opening 14 the plate 46 is closing during operation of the engine 10, operation of the engine 10 under heavy load conditions will cause the sequential relay 78 and the solenoid 60 to be deactuated and thus allow the plate 46 to be spring returned to the center position thereof illustrated in solid lines in FIG. 1.

It is to be noted that the manifold 12 is adapted to be utilized in conjunction with a four barrel carburetor. However, it is believed apparent that the invention may also be used in conjunction with a three barrel carburetor and also a two barrel carburetor wherein each of the barrels serves an individual intake manifold passage.

Further, the different types of passage valves may be used such as butterfly valves and all usable types of valves may be mounted in the manifold. Also, more simplified valve actuators may be used when it is desired to provide only one valve controlling a single air induction passage. It is also to be noted that the engine may comprise a diesel engine or gasoline engine equipped with fuel injection and that the valve used will block only the induction of air through the corresponding induction passage. In such instance, deactivation of the associated fuel injectors will also be effected by any suitable means.

It is further to be noted that partial closing of any induction passage valve used in conjunction with the instant invention will have the effect of reducing compression and thus reducing "spark" knock" or preignition.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In combination with a combustion engine of the type including an intake manifold defining a pair of air and fuel passages extending therethrough for supplying a fuel and air charge to separate sets of cylinders of a multicylinder engine and wherein the manifold includes a mounting face through which the inlet ends of said passages open for registry with the outlet end portions of corresponding air and fuel passages extending through a carburetor secured over said mounting face; an insert plate mounted between said mounting face and said carburetor, said insert plate having a pair of openings formed therethrough registered with said inlet ends and outlet end portions, valve means shiftably supported from said plate for movement between one of three positions, including a first position totally closing only one of said openings in the plate and with the second plate opening unobstructed to the flow of fluids therethrough, a second position totally closing only the other of said plate openings and with said one plate opening unobstructed to the flow of fluids therethrough and a third out-of-the-way position switch each of said pair of plate openings unobstructed to the flow of fluids therethrough.

2. The combination of claim 1 wherein said valve means is shiftably supported from said plate for oscillation back and forth between said first, second and third positions in a path disposed in a plane generally normal to the center axis of said openings.

3. The combination of claim 1 including shift means operatively connected to said valve means for alternately shifting said valve means between said first and second positions responsive to sequential periods of operation of the associated combustion engine.

4. The combination of claim 3 wherein said shift means includes a three position solenoid operative to shift said valve means between said first and second positions responsive to the sequential operation of said engine and means operative, responsive to deactivation of said solenoid, to yieldingly bias said valve means to said third position.

5. The combination of claim 4 wherein said shift means includes means operative to automatically deactuate said solenoid responsive to heavy load operation of said engine.

6. The method of increasing the life and fuel economy of a carburetor equipped combustion engine of the multicylinder type and including a pair of air and fuel intake passages for supplying an air and fuel mixture to separate sets of said cylinders, said method including totally blocking alternate intake passages of said engine downstream from the associated carburetor responsive to sequential periods of operation of said engine.

7. The method of claim 6 including unblocking the blocked intake passage of said engine responsive to heavy load operation of said engine.

* * * * *

UNITED STATES PATENT AND TRADEMARK OFFICE

CERTIFICATE OF CORRECTION

PATENT NO. : 4,428,337

DATED : January 31, 1984

INVENTOR(S) : William D. Parsons

It is certified that error appears in the above-identified patent and that said Letters Patent is hereby corrected as shown below:

Column 4, line 53, delete "switch" and substitute --with--.

Signed and Sealed this

First Day of May 1984

[SEAL]

*Attest:*

GERALD J. MOSSINGHOFF

*Attesting Officer*

*Commissioner of Patents and Trademarks*